US009061809B2

(12) United States Patent
Wilkins et al.

(10) Patent No.: US 9,061,809 B2
(45) Date of Patent: Jun. 23, 2015

(54) BASKET CARRIER INCLUDING OPEN-TOP BASKET AND LID

(75) Inventors: Zoe Claire Wilkins, Keynsham (GB); Paul Bradford, Staple Hill (GB)

(73) Assignee: Graphic Packaging International, Inc., Atlanta, GA (US)

( * ) Notice: Subject to any disclaimer, the term of this patent is extended or adjusted under 35 U.S.C. 154(b) by 1515 days.

(21) Appl. No.: 12/496,682

(22) Filed: Jul. 2, 2009

(65) Prior Publication Data

US 2010/0006458 A1 Jan. 14, 2010

(51) Int. Cl.

| | |
|---|---|
| ***B65D 85/30*** | (2006.01) |
| ***B65D 71/58*** | (2006.01) |
| ***B65D 71/38*** | (2006.01) |

(52) U.S. Cl.

CPC ..... *B65D 71/0022* (2013.01); *B65D 71/38* (2013.01); *B65D 2571/00141* (2013.01); *B65D 2571/00277* (2013.01); *B65D 2571/00388* (2013.01); *B65D 2571/00487* (2013.01); *B65D 2571/00574* (2013.01); *B65D 2571/00666* (2013.01); *B65D 2571/00728* (2013.01); *B65D 2571/0079* (2013.01)

(58) Field of Classification Search

USPC ..... 206/162, 163, 164, 165, 166, 167, 168, 206/169, 170, 171, 172, 173, 174, 175, 176, 206/180, 185

See application file for complete search history.

(56) References Cited

U.S. PATENT DOCUMENTS

| | | | | |
|---|---|---|---|---|
| 2,222,211 A | | 11/1940 | Arneson | |
| 2,225,822 A | | 12/1940 | Crook | |
| 2,227,330 A | | 12/1940 | Turner | |
| 2,331,312 A | | 10/1943 | Dorfman | |
| 2,336,857 A | | 12/1943 | Gies et al. | |
| 2,457,308 A | | 12/1948 | Hall et al. | |
| 2,660,361 A | | 11/1953 | Tyrseck | |
| 2,689,061 A | | 9/1954 | Gray | |
| 2,712,397 A | * | 7/1955 | Kowal | 206/191 |
| 2,772,020 A | | 11/1956 | Kramer | |
| 2,783,916 A | | 3/1957 | Hodapp | |
| 2,857,077 A | * | 10/1958 | Von Gaa | 206/180 |

(Continued)

FOREIGN PATENT DOCUMENTS

| | | |
|---|---|---|
| DE | 9004439 U1 | 6/1990 |
| EP | 1 319 607 A1 | 6/2003 |

(Continued)

*Primary Examiner* — Jacob K Ackun

(74) *Attorney, Agent, or Firm* — Womble Carlyle Sandridge & Rice, LLP

(57) ABSTRACT

A basket carrier is disclosed. The carrier includes an open-top basket and a lid for the basket. The basket includes a vertically-extending handle, a pair of side walls foldably connected to the handle by a plurality of divider walls, a pair of end walls foldably connected to the side walls and the handle, and a bottom wall formed by bottom flaps foldably connected to the side walls. The side walls, end walls, divider walls and handle together define a plurality of compartments for holding containers, such as bottles or cans. The handle may include a plurality of handle flaps that are partially separable from the handle to provide comfortable gripping surfaces for a user's hand. The lid includes a top panel for covering a top area of the basket, side panels for covering the side walls of the basket, and adhesive flaps detachably connected to the side panels for attaching the lid to the basket. A handle opening is provided in the top panel, laterally offset from the handle, to provide access to the handle of the basket. Blanks for forming the lid basket and lid are also disclosed.

17 Claims, 14 Drawing Sheets

(56) References Cited

U.S. PATENT DOCUMENTS

| | | | | | |
|---|---|---|---|---|---|
| 2,887,246 | A | * | 5/1959 | Levkoff | 206/180 |
| 2,991,908 | A | | 7/1961 | Conescu | |
| 3,053,411 | A | | 9/1962 | Struble | |
| 3,190,487 | A | | 6/1965 | Wood | |
| 3,191,800 | A | | 6/1965 | Kowal | |
| 3,229,849 | A | | 1/1966 | Spillson | |
| 3,236,414 | A | | 2/1966 | Slevin, Jr. | |
| 3,352,452 | A | | 11/1967 | Graser | |
| 3,669,306 | A | | 6/1972 | Forrer | |
| 3,721,368 | A | * | 3/1973 | Arneson | 206/180 |
| 3,860,113 | A | | 1/1975 | Helms | |
| 3,893,565 | A | | 7/1975 | Rossi et al. | |
| 3,917,059 | A | | 11/1975 | Wood | |
| 3,917,060 | A | | 11/1975 | Wood | |
| 3,917,061 | A | | 11/1975 | Stout | |
| 4,010,847 | A | | 3/1977 | Wood et al. | |
| 4,171,046 | A | | 10/1979 | Bonczyk | |
| 4,205,748 | A | | 6/1980 | Wilson | |
| 4,243,138 | A | | 1/1981 | Wilson | |
| 4,308,950 | A | | 1/1982 | Wood | |
| 4,362,240 | A | | 12/1982 | Elward | |
| 4,374,561 | A | | 2/1983 | Stout et al. | |
| 4,413,729 | A | | 11/1983 | Wood | |
| 4,450,956 | A | | 5/1984 | Wood | |
| 4,480,746 | A | | 11/1984 | Wood | |
| 4,509,640 | A | | 4/1985 | Joyce | |
| 4,610,349 | A | | 9/1986 | Schwartz et al. | |
| 4,722,437 | A | | 2/1988 | Walsh | |
| 4,782,943 | A | | 11/1988 | Blackman | |
| 4,782,944 | A | | 11/1988 | Engdahl, Jr. | |
| 4,792,038 | A | | 12/1988 | Cooper | |
| 4,927,009 | A | | 5/1990 | Stout | |
| 5,029,698 | A | | 7/1991 | Stout | |
| 5,040,672 | A | | 8/1991 | DeMaio et al. | |
| 5,161,732 | A | | 11/1992 | Clein et al. | |
| 5,167,325 | A | | 12/1992 | Sykora | |
| 5,234,103 | A | | 8/1993 | Schuster | |
| 5,400,901 | A | | 3/1995 | Harrelson | |
| 5,458,234 | A | | 10/1995 | Harris | |
| 5,499,712 | A | | 3/1996 | Harrelson | |
| 5,518,110 | A | | 5/1996 | Harrelson | |
| 5,531,319 | A | | 7/1996 | Harrelson | |
| 5,538,130 | A | | 7/1996 | Harrelson | |
| 5,538,131 | A | * | 7/1996 | Harrelson | 206/162 |
| 5,547,074 | A | | 8/1996 | Plaxico et al. | |
| 5,582,289 | A | * | 12/1996 | Wright | 206/139 |
| 5,590,762 | A | | 1/1997 | Harrelson | |
| 5,593,027 | A | | 1/1997 | Sutherland | |
| 5,645,162 | A | | 7/1997 | Harrelson | |
| 5,649,620 | A | | 7/1997 | Harrelson | |
| 5,657,864 | A | | 8/1997 | Harrelson | |
| 5,657,865 | A | | 8/1997 | Harrelson | |
| 5,682,982 | A | | 11/1997 | Stonehouse | |
| 5,695,051 | A | | 12/1997 | Hart | |
| 5,709,298 | A | | 1/1998 | Harris | |
| 5,775,487 | A | | 7/1998 | Harrelson | |
| 5,871,090 | A | | 2/1999 | Doucette et al. | |
| 5,878,877 | A | | 3/1999 | Sutherland | |
| 5,947,273 | A | | 9/1999 | Dalrymple et al. | |
| 6,041,920 | A | | 3/2000 | Hart et al. | |
| 6,131,729 | A | | 10/2000 | Eckermann et al. | |
| 6,155,962 | A | | 12/2000 | Dalrymple et al. | |
| 6,230,881 | B1 | | 5/2001 | Collura | |
| 6,247,585 | B1 | | 6/2001 | Holley, Jr. | |
| 6,315,111 | B1 | * | 11/2001 | Sutherland | 206/188 |
| 6,341,689 | B1 | | 1/2002 | Jones | |
| 6,371,287 | B1 | | 4/2002 | Jones et al. | |
| 6,571,941 | B2 | | 6/2003 | Holley, Jr. | |
| 6,736,260 | B2 | | 5/2004 | Gomes et al. | |
| 6,938,756 | B2 | | 9/2005 | Schuster | |
| 7,374,038 | B2 | | 5/2008 | Smalley | |
| 7,604,116 | B2 | | 10/2009 | Schuster | |
| 7,793,780 | B2 | | 9/2010 | Smalley | |
| 2002/0117407 | A1 | | 8/2002 | Holley | |
| 2003/0111363 | A1 | | 6/2003 | Theelen | |
| 2003/0159950 | A1 | | 8/2003 | Jones et al. | |
| 2003/0213705 | A1 | | 11/2003 | Woog | |
| 2004/0026269 | A1 | | 2/2004 | Cuomo | |
| 2005/0103651 | A1 | * | 5/2005 | Lebras | 206/162 |
| 2005/0230273 | A1 | | 10/2005 | Kohler | |
| 2006/0091024 | A1 | | 5/2006 | Cuomo | |
| 2006/0148629 | A1 | | 7/2006 | Cuomo | |
| 2007/0029212 | A1 | | 2/2007 | Smalley | |
| 2009/0008273 | A1 | | 1/2009 | Smalley | |
| 2010/0072086 | A1 | | 3/2010 | Smalley | |

FOREIGN PATENT DOCUMENTS

| | | | |
|---|---|---|---|
| EP | 08 713 743.6 | | 4/2009 |
| EP | 2 102 073 | B1 | 9/2010 |
| FR | 2 825 074 | A1 | 11/2002 |
| GB | 926874 | | 5/1963 |
| WO | WO-97/05026 | A1 | 2/1997 |
| WO | WO 99/01355 | | 1/1999 |

* cited by examiner

BASKET CARRIER INCLUDING OPEN-TOP BASKET AND LID

CROSS-REFERENCE TO RELATED APPLICATIONS

This application is a continuation of International Application No. PCT/US2008/050971, filed Jan. 14, 2008, entitled "Basket Carrier Including Open-Top Basket," which designates the United States of America and which claims the benefit under 35 U.S.C. §119(e) of U.S. Provisional Application No. 60/880,269, filed Jan. 12, 2007, U.S. Provisional Application No. 60/880,202, filed Jan. 12, 2007, and U.S. Provisional Application No. 60/880,221, filed Jan. 12, 2007.

BACKGROUND

Conventional open-top, paperboard baskets for carrying containers such as bottles and cans are often difficult and uncomfortable to carry. Particularly, the handles of traditional basket carriers often include thin-walled members with relatively sharp edges that cause discomfort to a person gripping the handle. In addition to being uncomfortable to grip, the handles in traditional basket carriers can often inflict cuts and abrasions on the hands of people carrying them.

Conventional open-top baskets typically also leave the containers held therein largely unprotected, as significant portions of the containers are not covered by the basket.

In view of the issues discussed above, it is desirable to provide a basket carrier including an open-top basket having an improved handle that is comfortable for gripping. It is also desirable to provide such a basket carrier with a detachable lid for covering the basket and protecting the containers held therein.

SUMMARY

The entire disclosures of International Application No. PCT/US2008/050971, U.S. Provisional Application No. 60/880,269, U.S. Provisional Application No. 60/880,202, and U.S. Provisional Application No. 60/880,221 are hereby incorporated by reference in their entirety as though fully set forth herein.

A basket carrier for carrying containers, such as bottles or cans, is disclosed. The basket carrier includes an improved basket and an improved lid for covering the basket.

According to one exemplary embodiment, a basket carrier includes a basket and a lid covering the basket. The basket may comprise a first basket side wall, a second basket side wall extending parallel to first basket side wall, a first basket end wall extending orthogonally between the first and second basket side walls, a second basket end wall extending between the first and second basket side walls parallel to the first basket end wall, a bottom wall extending between the first and second basket side walls and the first and second basket end walls, container compartments for holding containers, and a handle extending parallel to the basket side walls between the first and second basket end walls. The handle may include one or more grip openings for gripping the handle. The lid may include a horizontally extending lid top wall positioned over the handle, a downwardly extending first lid side wall foldably connected to a first lateral side of the lid top wall and positioned over the first basket side wall, a downwardly extending second lid side wall foldably connected to a second lateral side of the lid top wall and positioned over the second basket side wall, and a handle opening disposed in the lid top wall to allow a hand to access the handle.

According to another exemplary embodiment, a basket for carrying containers includes a first side wall, a second side wall extending parallel to first side wall, a first end wall extending orthogonally between the first and second side walls, a second end wall extending between the first and second side walls parallel to the first end wall, a bottom wall extending between the first and second side walls and the first and second end walls, a handle extending parallel to the side walls between the first and second end walls, first container compartments disposed on a first side of the basket; and second container compartments disposed on a second side of the basket. The handle may include a first handle portion and a second handle portion positioned against each other in back-to-back relationship. The first handle portion and the second handle portion may each be formed as a substantially flat panel. The handle may also include one or more first handle flaps formed in the first handle portion and one or more second handle flaps formed in the second handle portion and aligned with the one or more first handle flaps. The one or more first handle flaps may be at least partially separable from the first handle portion and the one or more second handle flaps may be at least partially separable from the second handle portion to form an opening for gripping the handle. The one or more first handle flaps and the one or more second handle flaps may further be foldable to form substantially flat gripping surfaces extending transversely to the first and second handle portions.

According to another exemplary embodiment, a basket lid may include a horizontally extending top wall, a downwardly extending first side wall foldably connected to a first lateral side of the top wall along a first fold line, a downwardly extending second side wall foldably connected to a second lateral side of the top wall a second fold line, and a handle opening disposed in the top wall and laterally offset from a central axis of the top wall extending parallel to the first and second fold lines, wherein the handle opening is configured to receive a person's hand.

Exemplary embodiments of blanks for forming a basket and a lid according to are also disclosed.

Other embodiments and aspects will become apparent to those of ordinary skill in view of the following.

DETAILED DESCRIPTION

Figure 7:
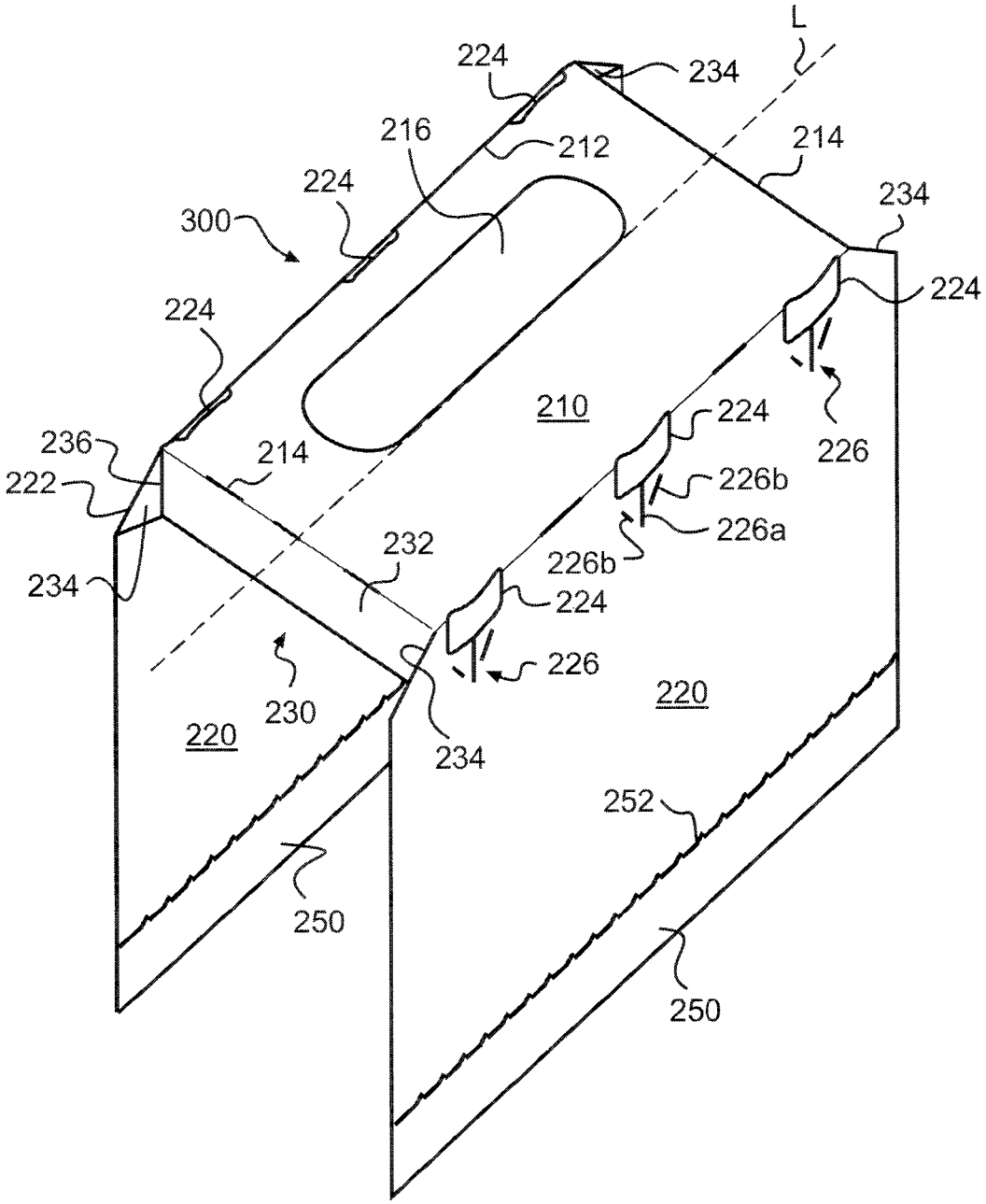
FIG. 7 is a perspective view of a lid formed from the blank of FIG. 6.
Figure 8:
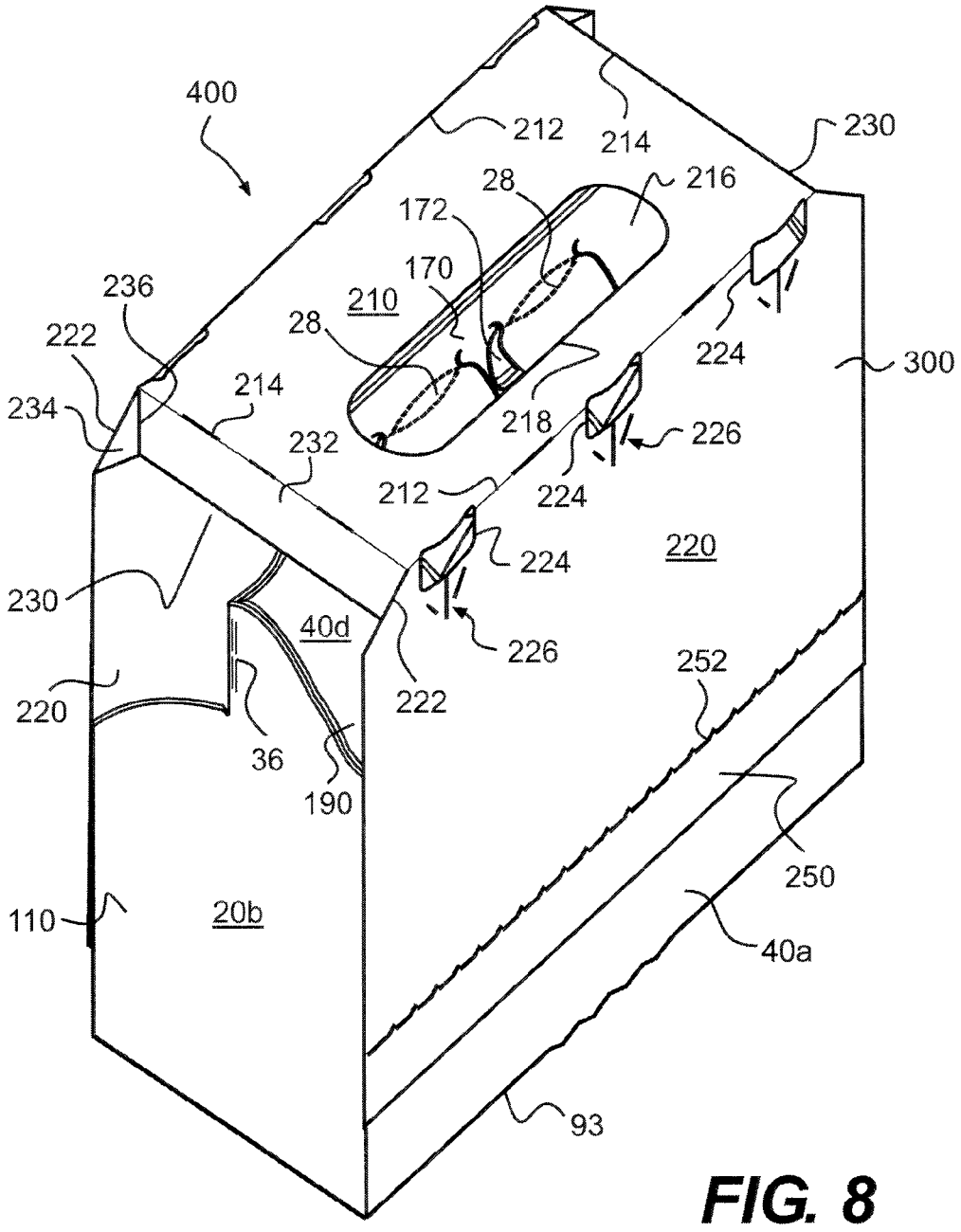
FIGS. 8 and 9 are perspective views of a basket carrier including the basket of FIGS. 4A-4D and the lid of FIG. 7.
Figure 9:
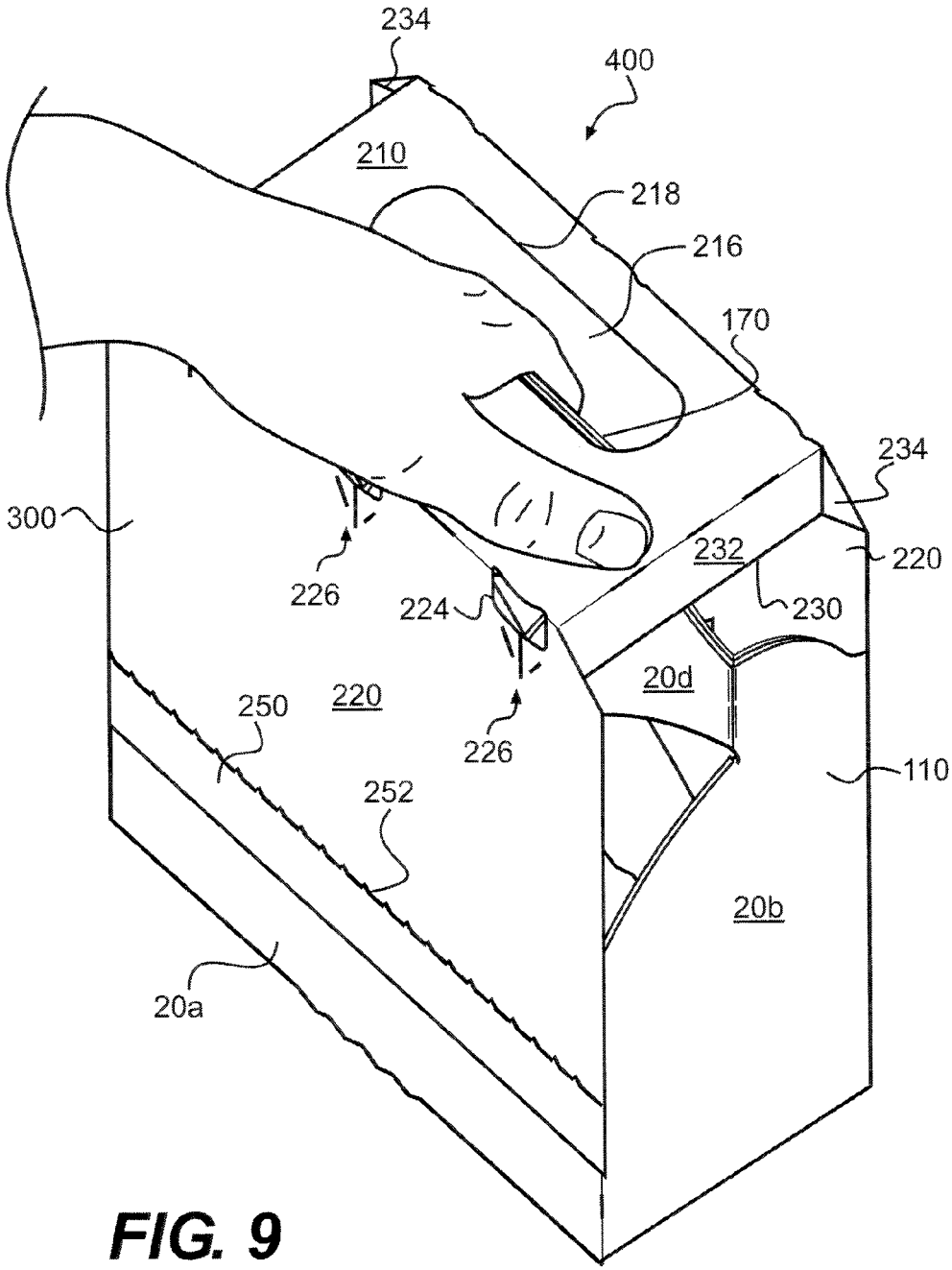

FIGS. 8 and 9 show a basket carrier or carton 400 including a basket 110 and a lid 300, in accordance with one embodiment of the present invention. The features of the basket 110, the lid 300 and blanks for forming the basket and the lid are described below with reference to FIGS. 1-7.

Figure 1:
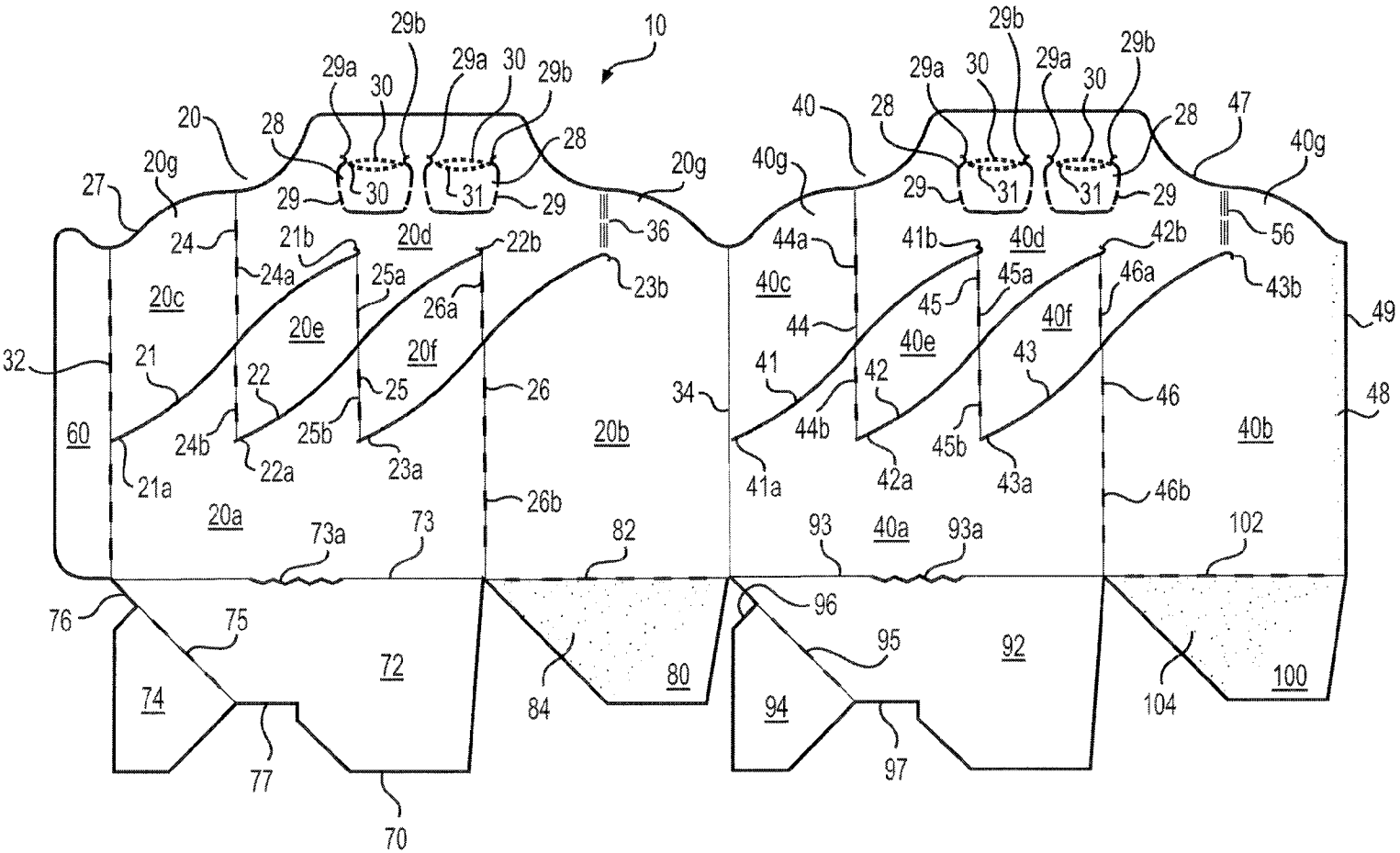
FIG. 1 is a plan view showing an outer side of a blank from which a basket of a basket carrier is formed.

FIG. 1 shows an outer side of a blank 10 for an open-top basket 110 (FIGS. 4A-4D) of a basket carrier 400 (FIGS. 8 and 9). The blank 10 may be constructed, for example, of paperboard or another suitable material. The blank 10 includes a first upper panel 20, a second upper panel 40 foldably connected to a first lateral edge of the first upper panel 20 along a central longitudinal fold line 34, and a side adhesive flap, or fastening flap 60 connected to a second lateral edge of the upper panel 20 along a longitudinal fold line 32. The blank 10 further includes a first bottom closure flap 70 foldably connected to a bottom edge of the first upper panel 20 along a lateral fold line 73, a first bottom adhesive flap 80 foldably connected to the bottom edge of the first upper panel 20 along a lateral fold line 82, a second bottom closure flap 90 foldably connected to a bottom edge of the second upper panel 40 along a lateral fold line 93, and a second bottom adhesive flap 100 foldably connected to the bottom edge of the upper panel 40 along a fold line 102.

As shown in FIG. 1, the upper panels 20, 40 are substantially rectangular and each include: a basket side wall portion 20*a*, 40*a*; a basket end wall portion 20*b*, 40*b* disposed adjacent to the side wall portion 20*a*, 40*a* at a right region of the panel 20, 40; a basket end wall reinforcement portion 20*c*, 40*c* disposed at an upper left region of the panel 20, 40; a basket handle portion 20*d*, 40*d* disposed at a central region of the panel 20, 40 above the side wall portion 20*a*, 40*a*; a first transverse divider wall portion 20*e*, 40*e* disposed adjacent to the end wall reinforcement panel portion 20*c*, 40*c*, between the handle portion 20*d*, 40*d* and the sidewall portion 20*a*, 40*a*; and a second transverse divider wall portion 20*f*, 40*f* disposed adjacent to the first transverse divider wall portion 20*e*, 40*e*, between the handle portion 20*d*, 40*d* and the sidewall portion 20*a*, 40*a*. The upper panels 20, 40 are also shown to have radiused upper corners 20*g*, 40*g*, which increase open area in the erected basket 110 and improve the aesthetics of the basket. It should be understood, however, that the upper panels 20, 40 may be have a shape that varies from the substantially rectangular shape shown.

The handle portions 20*d*, 40*d* each optionally include a pair of adjacent handle grip elements or flaps 28. The handle grip elements 28 are each formed by a substantially U-shaped cut line 29 having endpoints 29*a*, 29*b*, a convex fold line 30 extending between the endpoints 29*a*, 29*b*, and a concave fold line 31 extending between the endpoints 29*a*, 29*b* below convex the fold line 30. As will be described later, the handle grip elements 28 can be partially separated from the handle portion 20*d* and folded to expose handle openings 172 (FIGS. 4A, 4B and 5) for gripping by a person's hand.

The upper panel 20 includes a plurality of laterally-spaced, diagonally extending container compartment cut lines 21, 22, 23 positioned bellow the handle portion 20*d*, and a plurality of laterally-spaced, longitudinally extending interior fold lines 24, 25, 26. The cut lines 21, 22, 23 preferably extend entirely or substantially entirely through the thickness of the blank 10 such that the cut lines 21, 22, 23 can be opened to form compartments 190 (FIG. 4A) for bottles, cans or other containers C (FIG. 4D), as will be described later. Although the cut lines 21, 22, 23 are shown to be generally S-shaped, they may instead be substantially straight or have other suitable shapes. The arrangement of the cut lines 21, 22, 23 and the fold lines 24, 25, 26 is discussed below.

The outermost container compartment cut line 21 extends from a lower end 21*a*, which intersects the fold line 32, to an upper end 21*b*. The outermost interior fold line 24 extends from the upper edge of the panel 20 and is bisected into an upper segment 24*a* and a lower segment 24*b* by the cut line 21. The middle cut line 22 extends from a lower end 22*a*, which intersects a lower end of the interior fold line 24, to an upper end 22*b*. The middle interior fold line 25 extends from the upper end 21*a* of the cut line 21 to a lower end 23*a* of the innermost container cut line 23. The fold line 25 is bisected into an upper segment 25*a* and a lower segment 25*b* by the cut line 22. The container compartment cut line 23 extends from its lower end 23*a* to an upper end 23*b*. The innermost interior fold line 26 extends from the upper end 22*b* of the cut line 22 to the bottom edge of the panel 20, where it intersects the lateral fold lines 73, 82. The fold line 26 is bisected into an upper segment 26*a* and a lower segment 26*b* by the innermost container compartment cut line 23.

The panel 20 also includes a series of longitudinally extending slits or fold lines 36 extending between the upper end 23*b* of the cut line 23 and the upper edge 27 of the panel 20. The slits/fold lines 36 facilitate folding of the end wall portion 20*b*.

As can be understood from the foregoing description and FIG. 1, the side wall portion 20*a* is defined by the area outlined by the lower portion of the fold line 32, the lower portion of the cut lines 21, 22, 23 the line segments 24*b*, 25*b*, 26*b*, and the fold line 73. The end wall portion 20*b* is defined by the area outlined by the line segment 26*b*, the upper portion of the cut line 23, the slits/fold lines 36, the upper edge 27 of the panel 20 the fold line 34, and the fold line 82. The end wall reinforcement portion 20*c* is formed in the area outlined by the upper portion of the fold line 32, the upper edge 27 of the panel 20, the line segment 24*a* and the lower portion of the cut line 21. The handle portion 20*d* is defined in the area outlined by the line segments 24*a*, 25*a*, 26*a* the upper edge 27 of the panel 20, the slits/fold lines 36 and the upper portions of the cut lies 21, 22, 23. The divider panel portion 20*e* is formed in the area outlined by the upper portion of the cut line 21, the lower portion of cut line 22, the line segment 24*b* and the line segment 25*a*. The divider panel 20*f* is defined in the area surrounded by the upper portion of the cut line 22, the lower portion of the cut line 23, the line segment 25*b* and the line segment 26*a*.

Figure 4A:
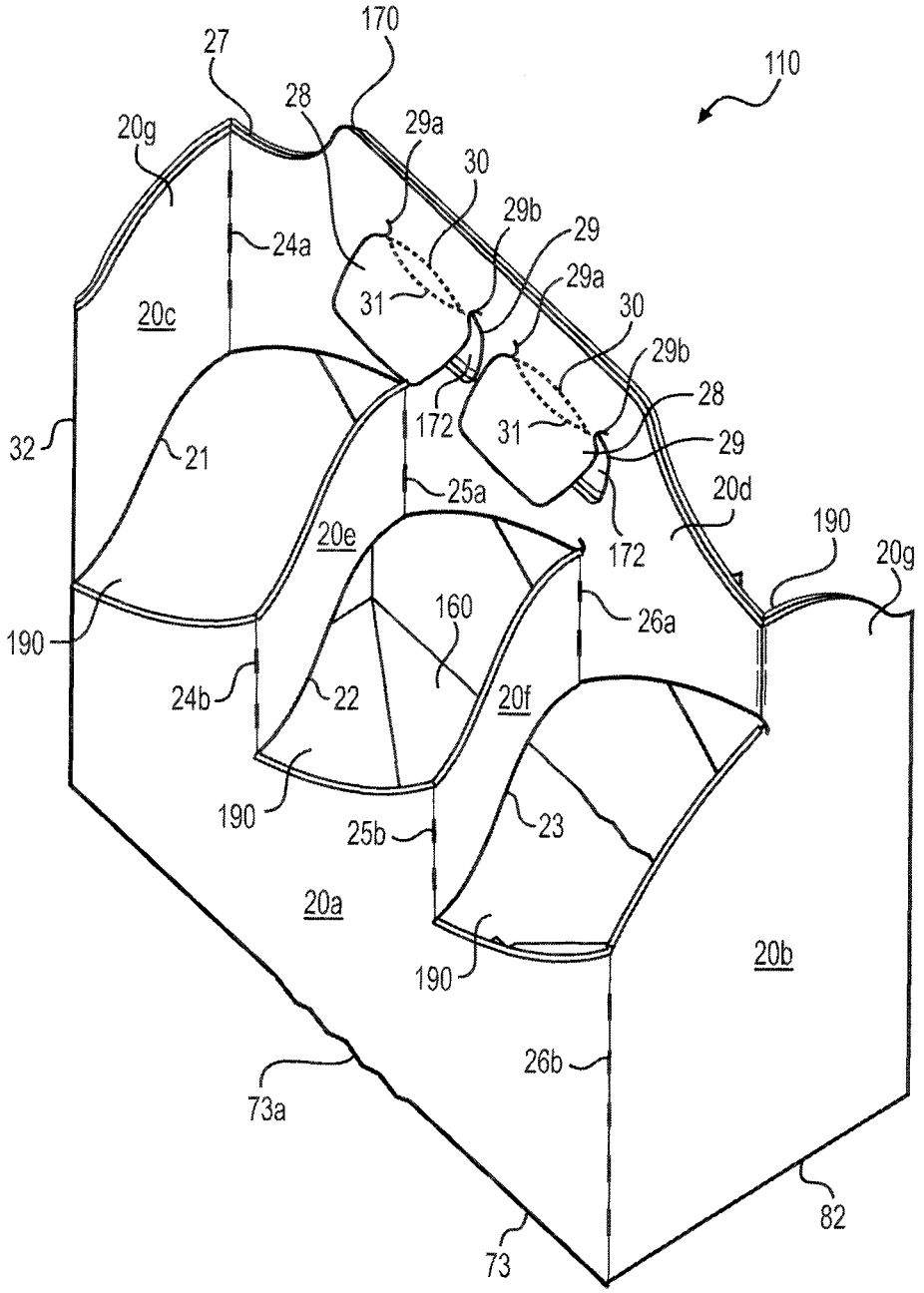
FIGS. 4A and 4B are perspective views of a basket erected from the blank of FIGS. 1-3B.
Figure 4B:
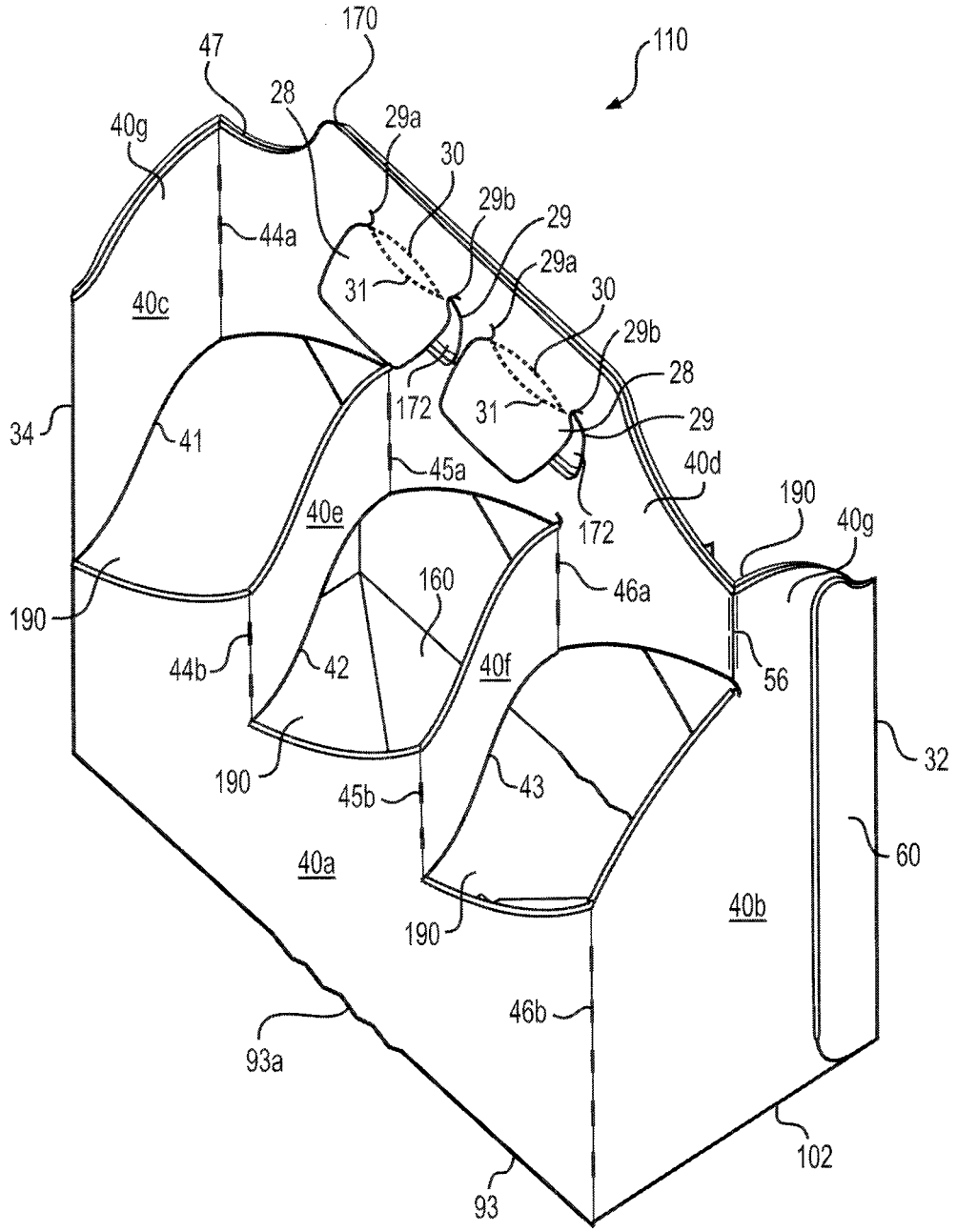

Still referring to FIG. 1, the second upper panel 40 is similar to the first upper panel 20. The upper panel 40 includes a plurality of laterally-spaced, diagonally extending container compartment cut lines 41, 42, 43 positioned bellow the handle portion 40*d*, and a plurality of laterally-spaced, longitudinally extending interior fold lines 44, 45, 46. In accordance with the embodiment shown in the drawings, the cut lines 41, 42, 43 have the same shape, structure and relative spacing as the cut lines 21, 22, 23 such that the cut lines 41, 42, 43 can be opened to form compartments 190 (FIG. 4B) for containers C (FIG. 4D).

The innermost container compartment cut line 41 extends from a lower end 21*a*, which intersects the central fold line 34, to an upper end 41*b*. The innermost interior fold line 44 extends from the upper edge of the panel 40 and is bisected into an upper segment 44*a* and a lower segment 44*b* by the cut line 41. The middle cut line 42 extends from a lower end 42*a*, which intersects a lower end of the interior fold line 44, to an upper end 42*b*. The middle interior fold line 45 extends from the upper end of the cut line 21 to a lower end 43*a* of the outermost container compartment cut line 43. The fold line 45 is bisected into an upper segment 45*a* and a lower segment 45*b* by the cut line 42. The outermost container compartment cut line 43 extends from its lower end 43*a* to an upper end 43*b*. The outermost interior fold line 46 extends from the upper end 42*a* of the cut line 42 to the bottom edge of the panel 40, where it intersects the lateral fold lines 93, 102. The fold line 46 is bisected into an upper segment 46*a* and a lower segment 46*b* by the outermost container compartment cut line 43.

The panel 40 also includes a series of longitudinally extending slits or fold lines 56 (similar to slits/fold lines 36) extending between the upper end 43*b* of the cut line 43 and the upper edge 47 of the panel 40.

The side wall portion 40*a* is defined by the area outlined by the lower portion of the fold line 34, the lower portion of the cut lines 41, 42, 43 the line segments 44*b*, 45*b*, 46*b*, and the fold line 93. The end wall portion 40*b* is defined by the area outlined by the line segment 46*b*, the upper portion of the cut line 43, the slits/fold lines 56, the upper edge 47 of the panel 40, the outer lateral edge 49 of the panel 40 and the fold line 102. The end wall reinforcement portion 40*c* is formed in the area outlined by the upper portion of the fold line 34, the upper edge 47 of the panel 40, the line segment 44*a* and the lower portion of the cut line 41. The handle portion 40*d* is defined in the area outlined by the line segments 44*a*, 45*a*, 46*a* the upper edge 47 of the panel 40, the slits/fold lines 56 and the upper portions of the cut lies 41, 42, 43. The divider panel portion 40*e* is formed in the area outlined by the upper portion of the cut line 41, the lower portion of cut line 42, the line segment 44*b* and the line segment 45*a*. The divider panel 40*f* is defined in the area surrounded by the upper portion of the cut line 42, the lower portion of the cut line 43, the line segment 45*b* and the line segment 46*a*.

Figure 2A:
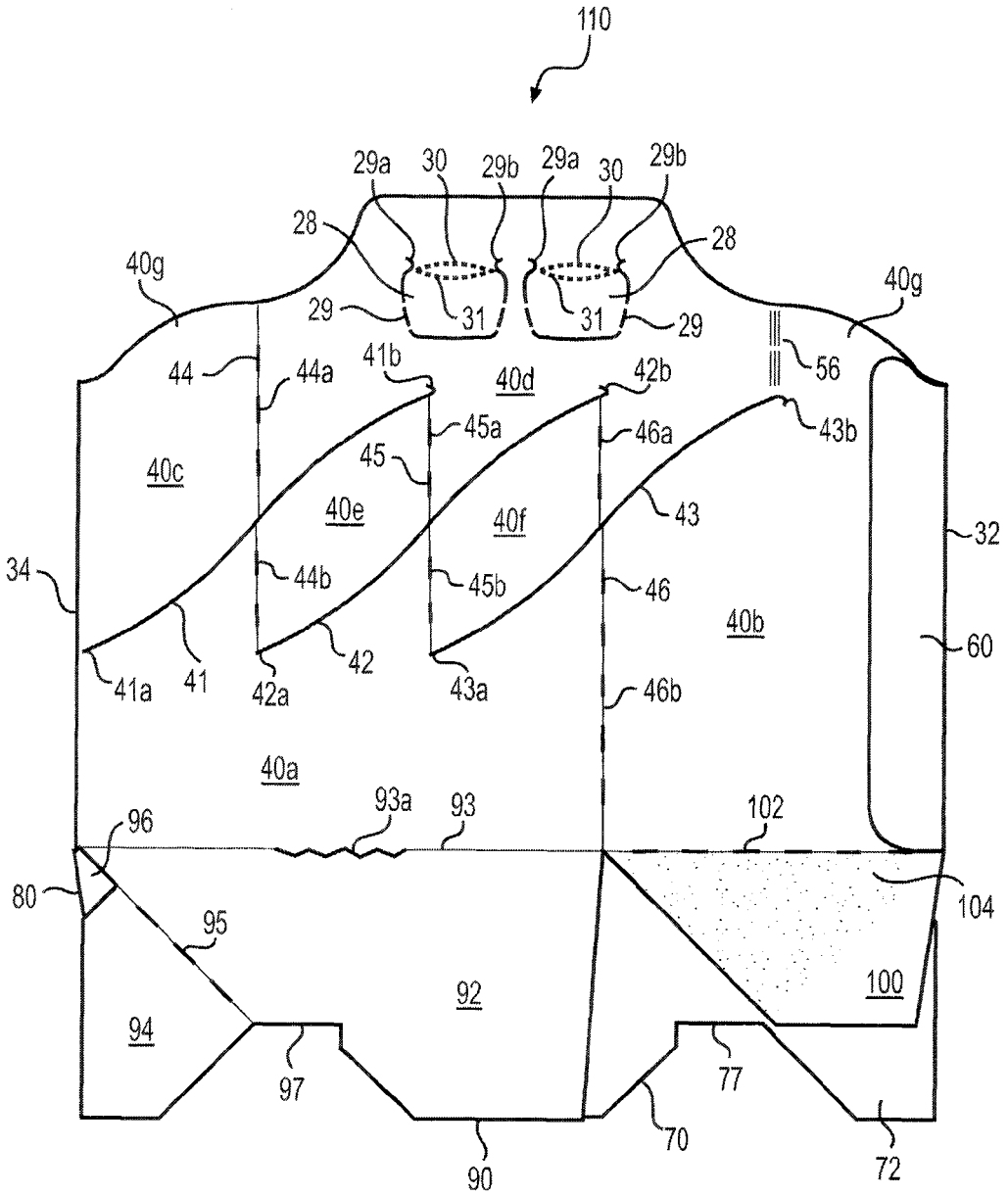
FIGS. 2A and 2B are plan views of the blank of FIG. 1 folded into a shipping or storage configuration.

The panel 40 may also be provided with an adhesive in the schematically illustrated region 48 near the outer lateral edge 49 of the end wall portion 40*b* for attaching the adhesive flap 60 thereto, as shown in FIG. 2A.

Due to the arrangement described above, the cut lines 21, 22, 23/41,42,43 and the fold lines 24, 25, 26/44, 45, 46 together allow folding of the side wall portion 20*a*/40*a*, the end wall portion 20*b*/40*b*, the end wall reinforcement portion 20*c*/40*c* and the transverse divider wall portions 20*e*, 20*f*/40*e*, 40*f*; and allow partial separation of the side wall portion 20*a*/40*a* from the end wall reinforcement portion 20*c*/40*c*, the handle portion 20*d*/40*d* and the transverse divider wall portions 20*e*, 20*f*/40*e*, 40*f* to form three container compartments 190 (FIGS. 4A and 4B) on each side of the basket 110. Thus, the basket 110, as configured, provides six container compartments 190. However, one of skill in the art will understand that the number of compartments can be increased or decreased by increasing or decreasing the number of cut lines 21, 22, 23/41,42,43 and fold lines 24, 25, 26/44, 45, 46.

Still referring to FIG. 1, the bottom closure flaps 70, 90 each include a major flap member 72, 92 that is generally trapezoidal in shape, and a generally trapezoidal minor flap member 74, 94 attached to the major flap member along a diagonal fold line 75, 95. Interlocking notches 77, 97 are provided between the major flap members 72, 92 and the minor flap members 74, 94 in middle lateral regions of the flaps 70, 90 to facilitate interlocking locking engagement of the flaps 70, 90 with each other in the erected basket 110. Clearance notches 76, 96 are also provided between the major flap members 72, 92 and the minor flap members 74, 94 at lateral edges near the intersection points of the lateral fold lines 73, 93 and the longitudinal fold lines 32, 34 to provide clearance during folding of the flaps 70, 90. Zig-zag shaped portions 73*a*, 93*a* may also be provided in the fold lines 73, 93 to facilitate folding of the flaps 70, 90 during erection of the basket 110.

The bottom adhesive flaps 80, 100 may be generally trapezoidal in shape to provide clearance with respect to the upper panels 20, 40 during folding of the blank 10 to erect the basket 110. The adhesive flaps 80, 100 may also include schematically illustrated adhesive regions 84, 104 on their inner surfaces for securing the bottom closure flaps 70, 80 to the adhesive flaps 80, 100.

Figure 2B:
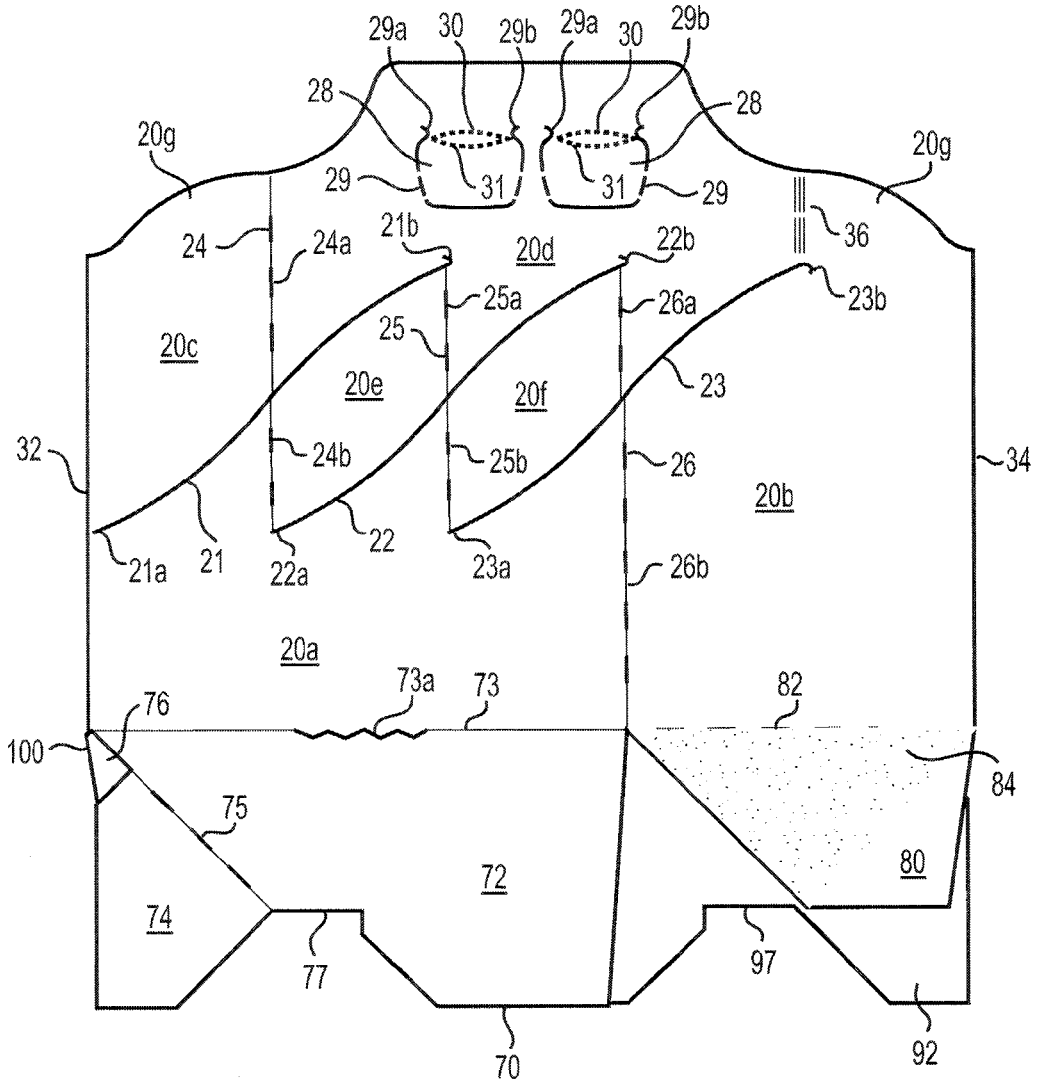
Figure 3A:
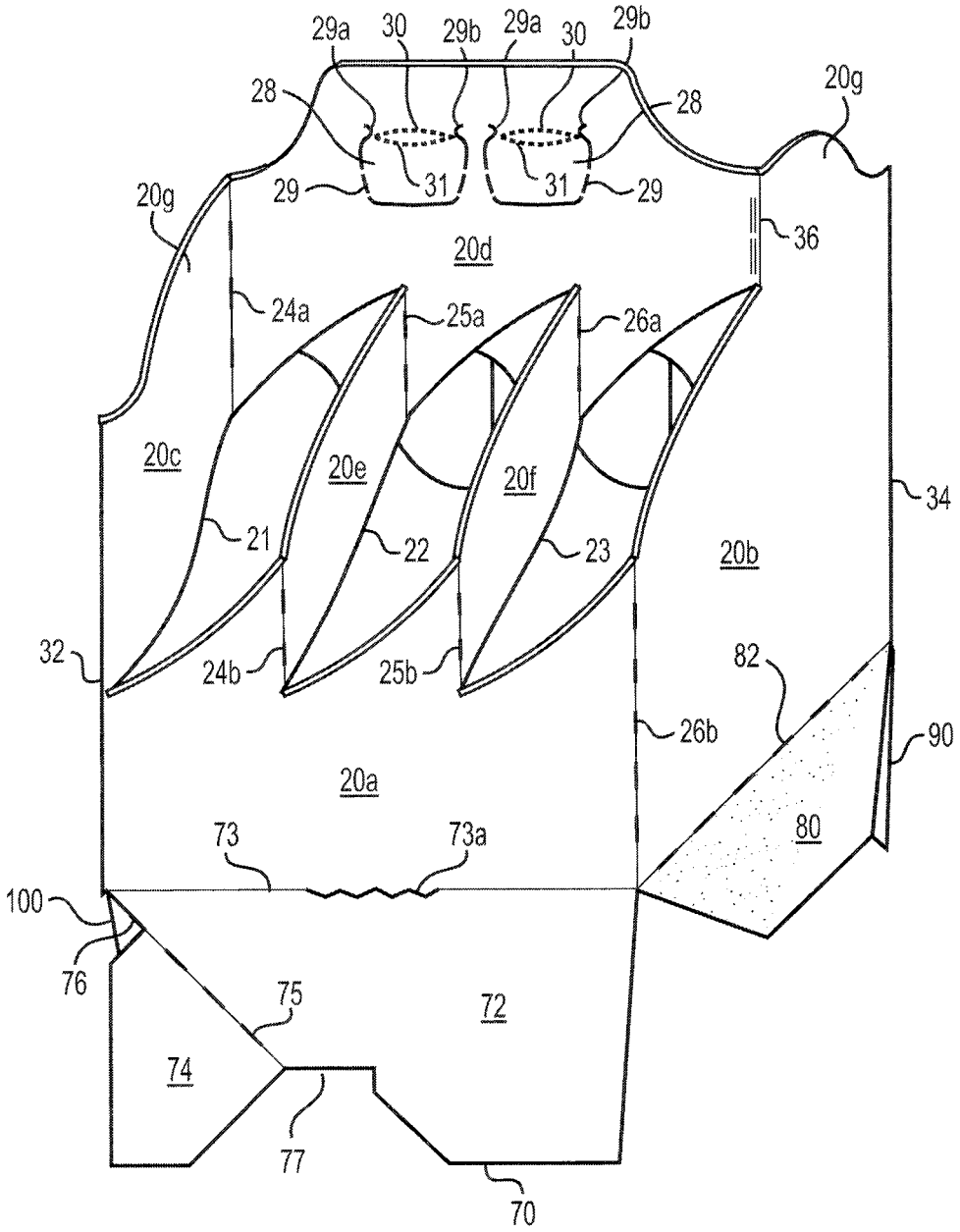
FIGS. 3A and 3B are perspective views of the blank of FIG. 1 folded from the configuration of FIG. 2 into an unfinished basket configuration.
Figure 3B:
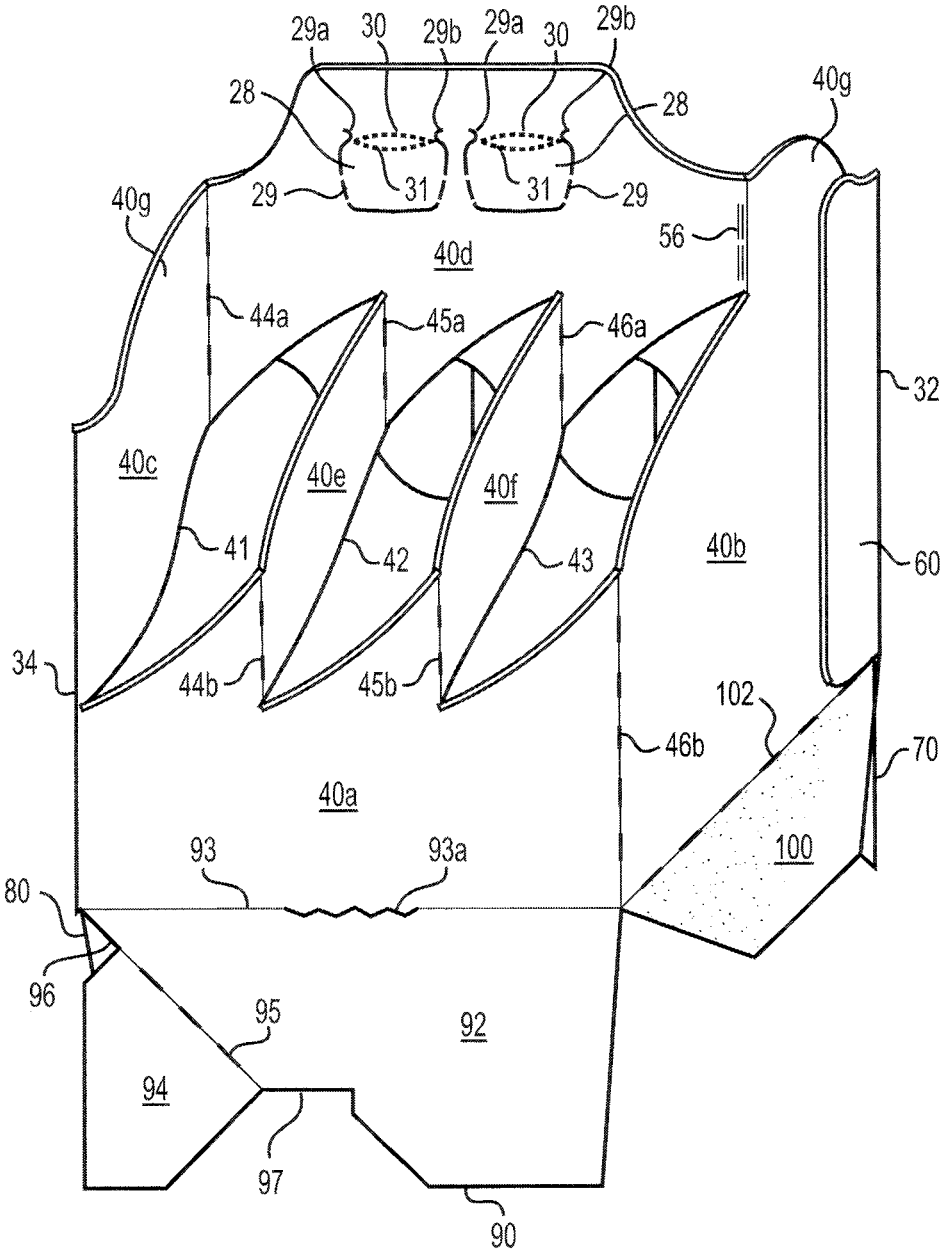

FIGS. 2A and 2B show the blank 10 folded into an example of what can be referred to as a storage or shipping configuration. In this configuration, the upper panels 20, 40 are folded together such that they lie substantially flat with their inside or back surfaces facing each other (i.e., back-to-back). The handle portions 20*d*, 40*d* may be adhered together to prevent relative movement between them, and the side adhesive flap 60 is folded downward about the fold line 32 such that the back side of the side adhesive flap 60 is adhered to the adhesive region 48 of the end wall portion 40*b*. In this configuration, the side wall portions 20*a*, 40*a* are laterally offset from each other, the handle portions 20*d*, 40*d* are aligned back-to-back with each other, the end wall portion 40*b* is aligned back-to-back with the end wall reinforcement portion 20*c*, the end wall portion 20*b* is aligned back-to-back with the end wall reinforcement portion 40*c*. From this configuration, the blank 10 may easily be erected into a basket 110.

The process of erecting a basket 110 from the blank 10 is illustrated in FIGS. 3A-4C and will be described in the following, in accordance with an embodiment of the invention. In a first step illustrated in FIGS. 3A and 3B, the blank 10 in the shipping configuration may be folded into the partially erected basket formation shown in FIG. 3 by, simultaneously: retaining the end wall reinforcement portion 40*c* against the end wall portion 20*b*; retaining the end wall reinforcement portion 20*c* against the end wall portion 40*b*; forcing the side wall portion 20*a* to fold outward, transversely to the lateral and longitudinal directions of the blank 10, about the lower portion of the fold line 32 and the lower segment 26*b* of the fold line 26, such that the sidewall portion 20*a* extends substantially parallel to the handle portion 20*d*; forcing the side wall portion 40*a* to fold outward, transversely to the lateral and longitudinal directions of the blank 10, about the lower portion of the fold line 34 and the lower segment 46*b* of the fold line 46, such that the sidewall portion 40*a* extends substantially parallel to the side wall portion 46*a* and the handle portion 40*d*; forcing the end wall portion 20*b* to fold about the line segment 26*b*, the slits/fold lines 36, and the fold line 34 such that the end wall portion 20*b* extends substantially orthogonally to the side wall portions 20*a*, 40*a*; and forcing the end wall portion 40*b* to fold about the line segment 46*b*, the slits/fold lines 56, and the fold line 32 of the side adhesive flap 60 (which is attached to the end wall portion 40*b*) such that the end wall portion 40*b* extends substantially orthogonally to the side wall portions 20*a*, 40*a* and parallel to the end wall portion 20*b*. Folding the blank in this manner causes the transverse divider wall portions 20*e*, 20*f*/40*e*, 40*f* to fold so as to extend transversely to the side wall portions 20*a*/40*a* and the handle portions 20*d*/40*d*. Specifically, the divider wall portions 20*e*, 40*e* fold about the lower line segments 24*b*, 44*b* of the fold lines 24, 44 and the respective upper line segments 25*a*, 45*a* of the fold lines 25, 45; while the divider wall portions 20*f*, 40*f* fold about the respective lower line segments 25*b*, 45*b* of the fold lines 25, 45 and the respective upper line segments 26*a*, 46*a* of the fold lines 26, 46.

Figure 4C:
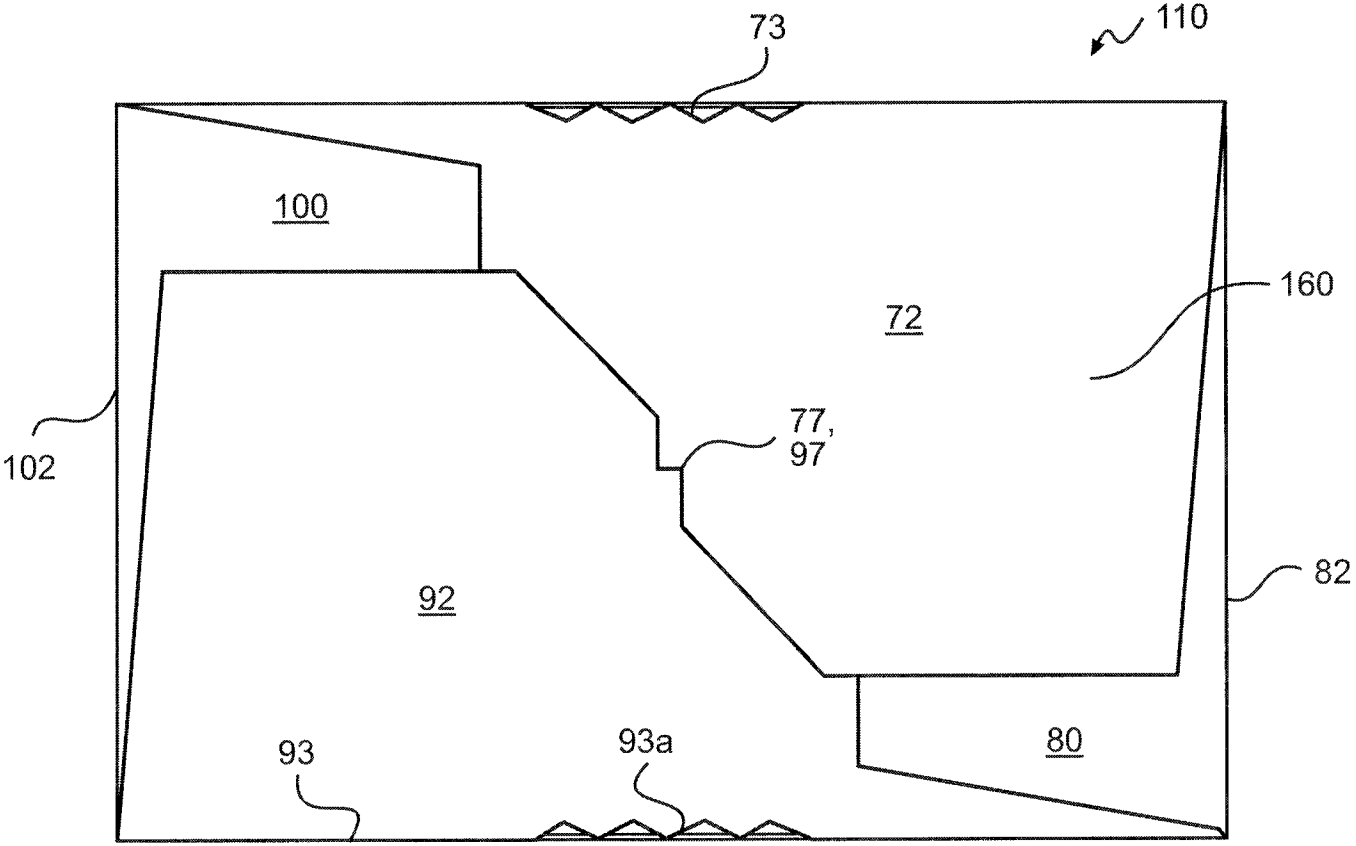
FIG. 4C is a bottom view of the basket of FIGS. 4A and 4B.
Figure 4D:
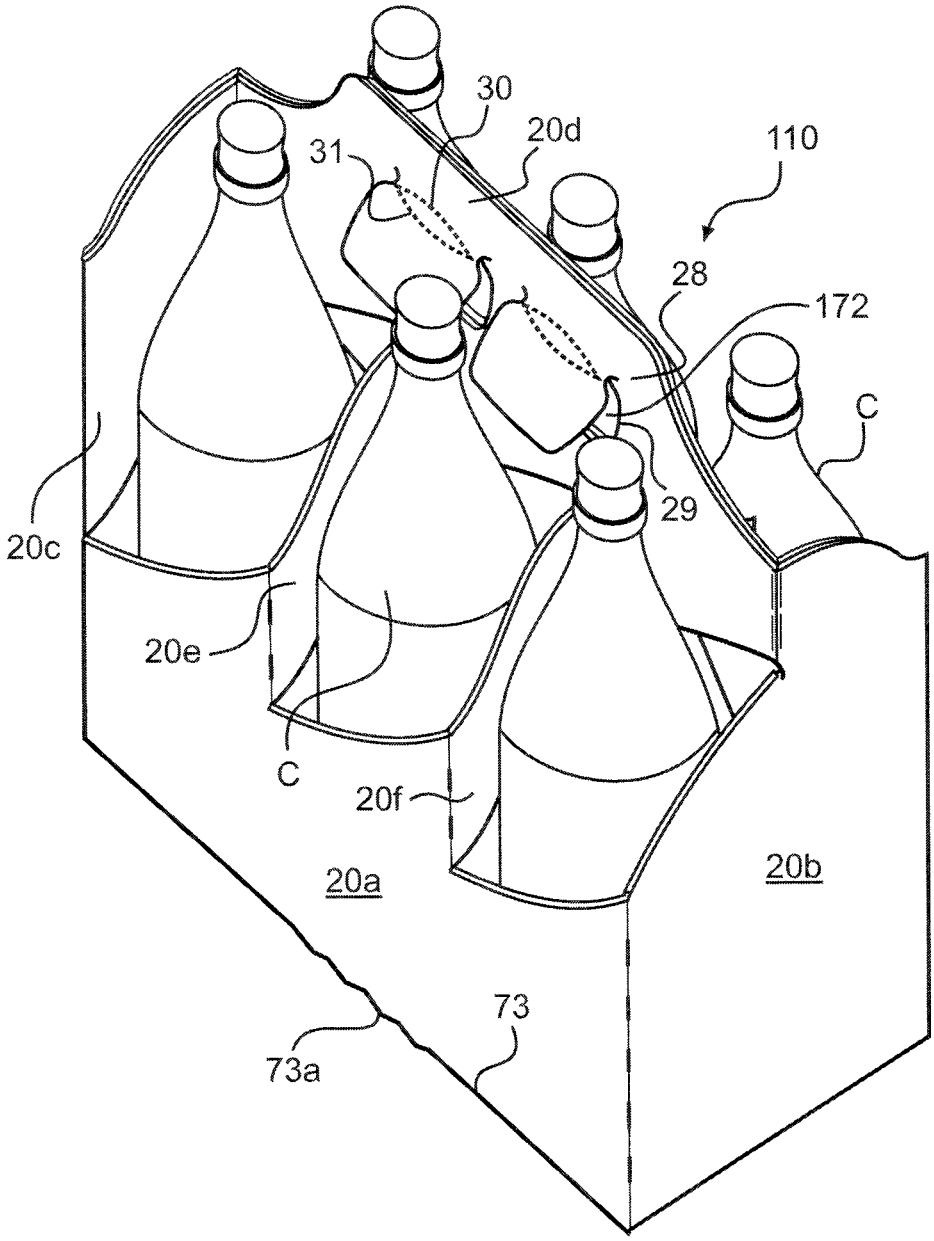
FIG. 4D is a perspective view of the basket of FIGS. 4A-4C loaded with containers.

Next, as shown in FIG. 4C, the bottom adhesive flaps 80, 100 in the formation of FIG. 3 are folded inward, and the bottom closure flaps 70, 90 are folded inward into interlocking engagement with each other with the minor flap members 74, 94 adhered to the inner surfaces of the adhesive flaps 100, 80. The bottom closure flaps 70, 90 are interlocked such that the interlocking notches 77, 97 engage each other, the major flap member 72 lies over the adhesive flap 80, and the major flap member 92 lies over the adhesive flap 100. Thus, the closure flaps 70, 90 are secured in a position substantially orthogonal to the side wall portions 20*a*, 40*a* and the end wall portions 20*b*, 40*b*, thereby forming a bottom wall 160, completing the erection of the basket 110. Differently configured bottom walls may be used.

As shown in FIGS. 4A-4D, the basket 110 includes: first and second side walls 20*a*, 40*a*; first and second end walls 20*b*, 40*b* extending orthogonally between the side walls 20*a*, 40*a* at opposite ends of the side walls; a bottom wall 160 formed by the bottom closure flaps 70, 90, which are respectively connected to the first and second side walls 20*a*, 40*a* along the fold lines 73, 93, and the bottom adhesive flaps 80, 100, which are respectively connected to the first and second end walls 20*b*, 40*b*; a handle 170 formed by first and second handle portions 20*d*, 40*d* in a center region of the basket 110 and extending between the end walls 20*b*, 40*b* above and parallel to the side walls 20*a*, 40*a*; first and second divider walls 20*e*, 20*f* extending at an inclined angle from the first side wall 20*a* to the handle 170; third and fourth divider walls 40*e*, 40*f* extending at an inclined angle from the second side wall 40*a* to the handle 170; and a plurality of container compartments 190 defined on opposing sides of the basket 110.

The end wall reinforcement portions 20*c*, 40*c* form reinforcing walls disposed parallel to the end walls 40*b*, 20*b* in back-to-back relationship with the end walls 20*b*, 40*b*. As can be seen in FIGS. 4A and 4B, the reinforcement walls 20*c*, 40*c* reinforce the end walls 40*b*, 20*b* and support the handle portions 20*d*, 40*d*.

Referring to FIG. 4A, the container compartments 190 on a first side of the basket 110 are defined by the first side wall 20*a*, the first handle portion 20*d*, the first and second end walls 20*b*, 40*b*, the first reinforcing wall 20*b*, and the bottom wall 160. Turning to FIG. 4B, the container compartments 190 on the second side of the basket 110 are defined by the second side wall 40*a*, the second handle portion 40*d*, the first and second end walls 20*b*, 40*b*, the second reinforcing wall 40*b*, and the bottom wall 160.

The handle 170 is configured such that the handle portions 20*d*, 40*d* form substantially flat handle panels aligned in a back-to-back configuration with the grip elements 28 in the handle portion 20*d* being aligned with the grip elements 28 in the handle portion 40*d*.

Referring to FIG. 4A, the first side wall 20*a* and the first end wall 20*b* are connected along the segment 26*b* of the fold line 26. The first divider wall 20*e* is connected to the first handle portion 20*d* along the segment 25*a* of the fold line 25 and is connected to the first side wall 20*a* along the segment 24*b* of the fold line 24. The second divider wall 20*f* is connected to the first handle portion 20*d* along the segment 26*a* of fold line 26 and is connected to the first side wall 20*a* along the segment 25*b* of the fold line 25 The first reinforcing wall 20*c* is connected to the first handle portion 20*d* along the segment 24*a* of the fold line 24. The first side wall 20*a* and the first reinforcing wall 20*c* are connected to the second end wall 40*b* by the adhesive flap 60, which extends parallel to the second end wall 40*b* and is connected to first side wall 20*a* and the first reinforcing wall 20*c* along the fold line 32.

Turning to FIG. 4B, the second side wall 40*a* and the second end wall 40*b* are connected along the segment 46*b* of the fold line 46. The third divider wall 40*e* is connected to the second handle portion 40*d* along the segment 45*a* of the fold line 45 and is connected to the first side wall 40*a* along the segment 44*b* of the fold line 44. The fourth divider wall 40*f* is connected to the second handle portion 40*d* along the segment 46*a* of the fold line 46 and is connected to the second side wall 40*a* along the segment 45*b* of the fold line 45. The second reinforcing wall 40*c* is connected to the second handle portion 40*d* along the segment 44*a* of the fold line 44. The second side wall 40*a* and the second reinforcing wall 40*c* are connected to the first end wall 20*b* along the fold line 34.

Figure 5:
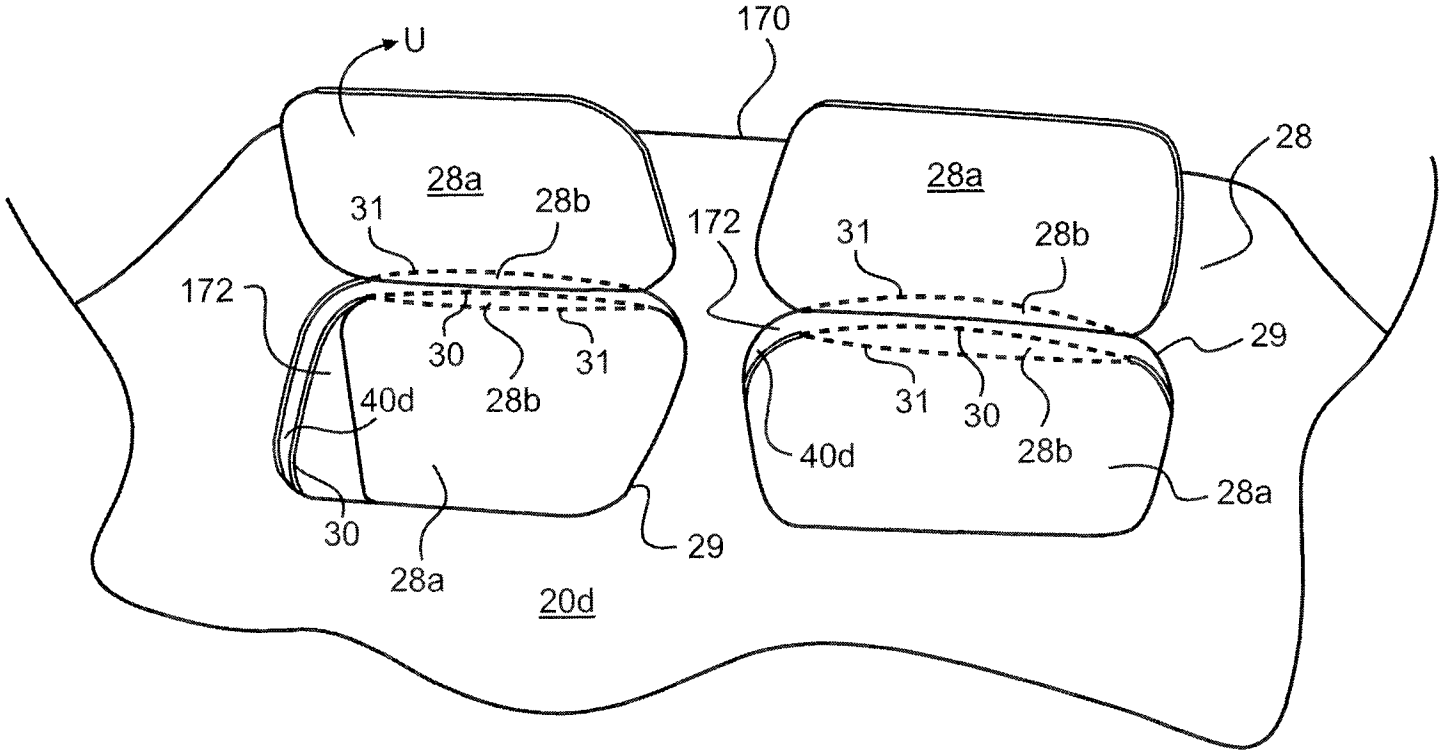
FIG. 5 shows a handle of the basket of FIGS. 4A-4D.

As best shown in FIG. 5, to facilitate carrying the basket 110, each handle grip element 28 can be partially separated from the respective handle portion 20*d*, 40*d* and folded outward about the fold line 30 to expose a pair of handle openings 172 and to cause the portion 28*b* of the grip element 28 between the convex fold line 30 and the concave fold line 31 to extend transversely to the remainder of the handle 170. Thus, the inner surface of the portion 28*b* of the grip element 28 forms a lateral gripping surface against which a person's fingers can rest when the handle 170 is gripped. The portion 28*a* of the grip element 28 defined within the fold line 31 and the U-shaped cut line 29 can be folded further upward, in the direction U, about the fold line 31 such that the inner surface of the portion 28*a* forms a substantially vertical gripping surface for a person's fingers. Thus, the finger grip elements 28 form large, comfortable surfaces that can be gripped by a person's fingers while reducing the likelihood that the handle 170 will injure or irritate a person's hand while carrying the basket 110.

Figure 6:
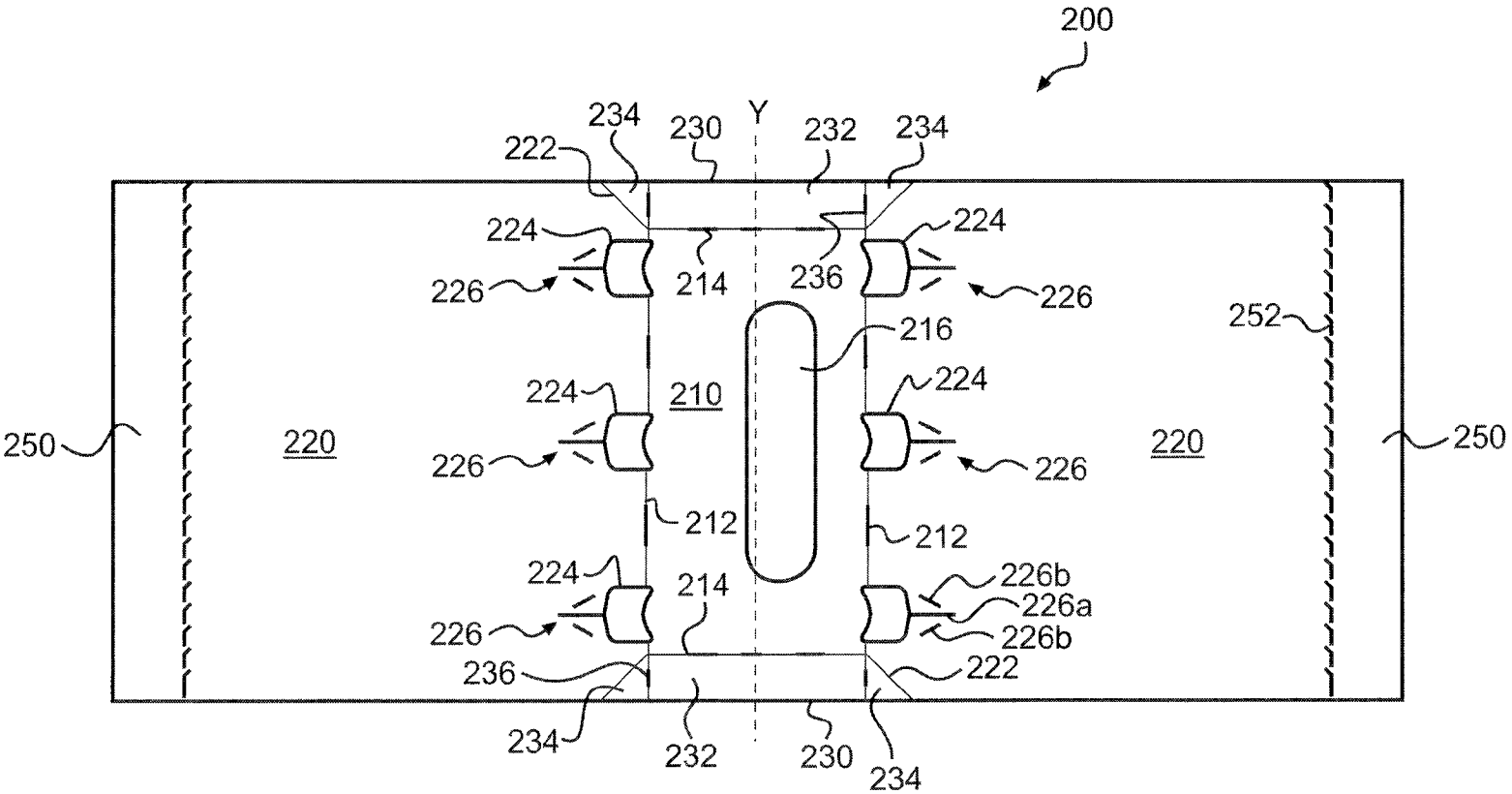
FIG. 6 is a plan view of a blank from which a lid for the basket carrier is formed.

FIG. 6 shows the outer surface of a blank 200 for forming a lid 300 of a basket carrier 400 (FIGS. 7A and 7B). The blank 200 includes: a rectangular top wall panel 210 disposed at a center of the blank; a pair of substantially rectangular side wall panels 220 foldably connected to opposite lateral sides of the top wall panel 210 along longitudinally extending fold lines 212; a pair of trapezoidal web panels 230 foldably connected to ends of the top wall panel 210 and foldably connected to the side wall panels 220; and a pair of adhesive flaps 250 foldably and detachably connected to the side wall panels 220 along lines of weakness 252 (e.g., tear lines). The adhesive flaps 250 may include adhesive on their inner surfaces for attaching the flaps 250 to the basket 110, as will be described later.

The web panels 230 each include a rectangular panel member 232 foldably connected to the top wall panel 210 along a laterally extending fold line 214. Each web panel 230 further includes a pair of gusset members 234 foldably connected to the rectangular panel member 232 and one of the side wall panels 220. Each of the gusset members 234 is connected to a respective one of the panel members 232 along a longitudinal fold line 236, which is collinear with a respective one of the fold lines 212. Each gusset member 234 is also connected to a respective one of the side wall panels 220 along a diagonal fold line 222.

The top wall panel 210 includes a handle opening 216 which is sized and shaped to expose the handle 170 of the basket 110 and to accommodate a person's hand when the blank is formed into the lid 300 on the basket. The handle opening 216 has an oval shape and extends lengthwise in the longitudinal direction of blank 200. The opening 216 is laterally offset from a central longitudinal axis Y (extending parallel to the fold lines 212) of the top wall panel 210 to provide better access to the handle 170, as will be described in more detail later. A plurality of openings 224 are provided near laterally inner regions of the side wall panels 220 for receiving the tops of containers C held within the basket 110. The openings 224 are spaced to correspond to the container compartments 190 in the basket 110. As shown in FIG. 8, the openings 224 may partially extend across the fold lines 212 into the top wall panel 210. Weakening patterns 226 are provided in the side wall panels 220 laterally adjacent to the openings 224. Each weakening pattern 226 may include a plurality of lines of weakness (e.g., slits and/or tear lines), such as a central line of weakness 226*a* extending laterally from the opening 224 and a pair of diagonal lines of weakness 226*b* disposed on opposite sides of the central line of weakness 226*a*. it should be understood that, although any number of openings 224 may be provided, the openings 224 should be equal in number to the container compartments 290 of the basket 110.

FIG. 7 shows a lid 300 formed by the blank 200. To form the lid 300, the side wall panels 220 are folded towards each other about the fold lines 212 such that the side wall panels 220 and adhesive flaps 250 extend transversely to the top wall panel 210 and the back sides of the side panels 220 face each other. The rectangular panel members 232 are folded inward towards each other about the fold lines 214 such that the rectangular panel members 232 extend and transversely to the side panels 220 and the top wall panel 210. The gusset members 234 are folded about the fold lines 236, 222 such that the gusset members 234 extend transversely between the respective side panel 220 and rectangular panel member 232.

Thus, as indicated in FIG. 7, the lid 300 includes a substantially horizontal top wall 210, substantially downwardly extending side walls 220 connected to opposite sides of the top wall 210 along fold lines 212, a pair of trapezoidal web panels 230 formed foldably connected to opposite ends of the top panel 210 and to the side panels 220, and a pair of adhesive flaps 250 foldably and detachably connected to the side walls 220 along the lines of weakness 252. The lid is configured such that the handle access opening 216 is laterally offset from the central longitudinal axis L of the top wall 210. The lid 300 is also configured such that the container top openings 224 and weakening patterns 226 positioned in upper portions of the side walls 220, with the openings 224 extending partially into the top wall 210.

Referring to FIGS. 8 and 9, to form the basket carrier 400, the lid 300 is first positioned over the basket 110 such that each of the side walls 220 of the lid 300 is aligned with a side wall 20*a*/40*a* of the basket 110, and the top wall 210 of the lid 300 is positioned over the handle 170. The lid 300 is then attached to basket by attaching the adhesive flaps 250 to the side walls 20*a*, 40*a*.

Thus, as shown in FIGS. 8 and 9, the carrier 400 is formed such that the side walls 320 of the lid 300 cover the side walls 20*a*, 40*a* and the container compartments 190 of the basket 110, and the top wall 310 of the lid 300 extends over the handle 170 of the basket 110 to cover the open top of the basket 110. Each of the container top openings 224 is aligned with and positioned above one of the container compartments 190, and the handle access opening 216 is laterally offset from the handle 170, with the handle 170 being positioned beneath the opening 216. Although the handle access opening 216 is laterally offset from the handle 170, the handle 170 may be positioned within or close to the perimeter 218 of the opening 216 to provide optimum access to the handle 170. Therefore, a person can easily grab and carry the carrier 400 by inserting his hand into the opening 216, inserting his fingers through the handle openings 172, and gripping the handle 170. The relative positioning of the handle 170 and the opening 216 provides generous space for a person's hand and comfortable positioning of the hand in the carrier 400.

To remove containers C from the carrier 400 with the lid installed, the containers C can be pulled through the openings 224. As containers C are pulled through the openings 224, the weakening patterns 226 will partially separate from the side walls 320, thereby expanding the openings 226 to facilitate removal of the containers.

Access to the containers C can also be gained by detaching the side walls 220 from the adhesive flaps 250 along lines of weakness 252, such that the adhesive flaps 250 remain attached to the side walls 20*a*, 40*a* of the basket 110 and the remainder of the lid 300 is removed from the basket 110.

In accordance with the exemplary embodiments, the cartons (i.e., basket and lid) may be constructed of paperboard, for example. The paperboard webs used to form the blank may be thicker and heavier than ordinary paper. The blanks, and thus the carton and lid, can also be constructed of other materials, such as cardboard, or any other material having properties suitable for enabling the cartons to function at least generally as described above. For example, the blanks may be formed from coated solid unbleached sulfate (SUS) board. The blanks can also be laminated to or coated with one or more web-like materials at selected panels or panel sections.

One or more panels of the blanks discussed above can be coated with varnish, clay, or other materials, either alone or in combination. The coating may then be printed over with product, advertising, and other information or images. The blanks may also be coated to protect any information printed on the blank. The blanks may be coated with, for example, a moisture barrier layer, on either or both sides of the blanks.

In accordance with the exemplary embodiments, a fold line or line of weakness can be any substantially linear, although not necessarily straight, form of weakening that facilitates folding therealong. More specifically, but not for the purpose of narrowing the scope of the present invention, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line. A pattern of weakness can be any pattern which serves as a form of weakening to facilitate folding or tearing.

The term "line" as used herein includes not only straight lines, but also other types of lines such as curved, curvilinear or angularly displaced lines.

In the present specification, a "panel" need not be flat or otherwise planar. A "panel" can, for example, comprise a plurality of interconnected generally flat or planar sections.

In the present specification, reference is made to various directions, such as "vertical," "lateral," "longitudinal," variations thereof. It should be understood that such descriptions are provided to facilitate understanding of the relative orientation of various elements described herein, and are not intended to be limiting.

The foregoing description of the invention illustrates and describes the present invention. Additionally, the disclosure shows and describes only selected embodiments of the invention, but it is to be understood that the invention is capable of use in various other combinations, modifications, and environments and is capable of changes or modifications within the scope of the inventive concept as expressed herein, commensurate with the above teachings, and/or within the skill or knowledge of the relevant art.

We claim:

1. A basket carrier for carrying containers, the basket carrier comprising:

a basket comprising a first basket side wall, a second basket side wall extending parallel to the first basket side wall, a first basket end wall extending orthogonally between the first and second basket side walls, a second basket end wall extending between the first and second basket side walls parallel to the first basket end wall;

a bottom wall extending between the first and second basket side walls and the first and second basket end walls;

a handle extending parallel to the first and second basket side walls between the first and second basket end walls, the handle including at least one grip opening for gripping the handle, and container compartments for holding containers;

a lid connected to and covering the basket, the lid comprising a horizontally extending lid top wall positioned over the handle;

a handle opening disposed in the lid top wall to allow a hand to access the handle;

a downwardly extending first lid side wall foldably connected to a first lateral side of the lid top wall and positioned over the first basket side wall; and a downwardly extending second lid side wall foldably connected to a second lateral side of the lid top panel wall and positioned over the second basket side wall.

2. The basket carrier of claim 1, wherein the handle opening is laterally offset from the handle.

3. The basket carrier of claim 1, wherein the lid comprises:

a first adhesive flap detachably connected to the first lid side wall along a first line of weakness and adhered to the first basket side wall, and a second adhesive flap detachably connected to the second lid side wall along a second line of weakness and adhered to the second basket side wall.

4. The basket carrier of claim 1, wherein the lid comprises container access openings disposed partially in the lid side walls and partially in the lid top, wherein the container access openings are aligned with the container compartments.

5. The basket carrier of claim 4, wherein the lid comprises weakening patterns positioned to allow enlargement of the container access openings.

6. The basket carrier of claim 1, wherein the handle comprises:

a first handle portion and a second handle portion positioned against each other in back-to-back relationship, the first handle portion and the second handle portion each being formed as a substantially flat panel;

at least one first handle flap formed in the first handle portion; and at least one second handle flap formed in the second handle portion and aligned with the at least one first handle flap, wherein the at least one first handle flap is partially separable from the first handle portion and the at least one second handle flap is partially separable from the second handle portion to form the at least one grip opening, the at least one first handle flap is foldable to form a first substantially flat gripping surface extending transversely to the first and second handle portions, and the at least one second handle flap is foldable to form a second substantially flat gripping surface extending transversely to the first and second handle portions.

7. The basket carrier of claim 6, wherein:

the first handle flap is defined by a first substantially U-shaped cut line in the first handle portion, a first convex fold line extending between endpoints of the first substantially U-shaped cut line, and a first concave fold line extending between the endpoints of the first substantially U-shaped cut line; and the second handle flap is defined by a second substantially U-shaped cut line in the second handle portion, a second convex fold line extending between endpoints of the second substantially U-shaped cut line, and a second concave fold line extending between the endpoints of the second substantially U-shaped cut line.

8. The basket carrier of claim 7, wherein:

the first substantially flat gripping surface is defined by the first convex fold line and the first concave fold line; and the second substantially flat gripping surface is defined by the second convex fold line and the second concave fold line.

9. The basket carrier of claim 7, wherein:

the first handle flap is foldable to form a first substantially vertical gripping surface defined by the first substantially U-shaped cut line and the first concave fold line; and the second handle flap is foldable to form a second substantially vertical gripping surface defined by the second substantially U-shaped cut line and the second concave fold line.

10. A basket for carrying a plurality of containers, the basket comprising:

a first side wall;

a second side wall extending parallel to the first side wall;

a first end wall extending orthogonally between the first and second side walls, a second end wall extending between the first and second side walls parallel to the first end wall;

a bottom wall extending between the first and second side walls and the first and second end walls;

a handle extending parallel to the side walls between the first and second end walls, the handle comprising a first handle portion and a second handle portion positioned against each other in back-to-back relationship, the first handle portion and the second handle portion each being formed as a substantially flat panel;

at least one first handle flap formed in the first handle portion;

at least one second handle flap formed in the second handle portion and aligned with the at least one first handle flap;

at least one of the at least one first handle flap and the at least one second handle flap is defined by a first substantially U-shaped cut line in the respective first handle portion or second handle portion, a first convex fold line extending between endpoints of the first substantially U-shaped cut line, and a first concave fold line extending between the endpoints of the first substantially U-shaped cut line;

a plurality of first container compartments disposed on a first side of the basket; and a plurality of second container compartments disposed on a second side of the basket, wherein the at least one first handle flap is partially separable from the first handle portion and the at least one second handle flap is partially separable from the second handle portion to form an opening for gripping the handle, the at least one first handle flap is foldable to form a first substantially flat gripping surface extending transversely to the first and second handle portions, and the at least one second handle flap is foldable to form a second substantially flat gripping surface extending transversely to the first and second handle portions.

11. The basket of claim 10, wherein:

the first handle flap is defined by the first substantially U-shaped cut line in the first handle portion, the first convex fold line extending between endpoints of the first substantially U-shaped cut line, and the first concave fold line extending between the endpoints of the first substantially U-shaped cut line; and the second handle flap is defined by a second substantially U-shaped cut line in the second handle portion, a second convex fold line extending between endpoints of the second substantially U-shaped cut line, and a second concave fold line extending between the endpoints of the second substantially U-shaped cut line.

12. The basket of claim 11, wherein:

the first substantially flat gripping surface is defined by the first convex fold line and the first concave fold line; and the second substantially flat gripping surface is defined by the second convex fold line and the second concave fold line.

13. The basket of claim 11, wherein:

the first handle flap is foldable to form a first substantially vertical gripping surface defined by the first substantially U-shaped cut line and the first concave fold line; and the second handle flap is foldable to form a second substantially vertical gripping surface defined by the second substantially U-shaped cut line and the second concave fold line.

14. The basket of claim 10, comprising:

a first reinforcement wall disposed in back-to-back relationship with the second end wall, wherein the first reinforcement wall is foldably connected to the first handle portion and is foldably connected to a side flap that is adhered to the second end wall; and a second reinforcement wall disposed in back-to-back relationship with the first end wall, wherein the second reinforcement wall is foldably connected to the second handle portion and the first end wall.

15. The basket of claim 14, comprising:

at least one first divider panel foldably connected to the first side wall and the first handle portion, wherein the at least one first divider panel, the first handle portion, the first reinforcement wall, the first side wall and the first end wall and the bottom wall together define the plurality of first container compartments; and at least one second divider panel foldably connected to the second side wall and the second handle portion, wherein the at least one second divider panel, the second handle portion, the second reinforcement wall, the second side wall, the second end wall and the bottom wall together define the plurality of second container compartments.

16. The basket of claim 14, wherein:

the first side wall is foldably connected to the side flap; and the second side wall is foldably connected to the first end wall.

17. The basket of claim 10, wherein:

the first end wall is foldably connected to the first handle portion; and the second end wall is foldably connected to the second handle portion.

* * * * *

UNITED STATES PATENT AND TRADEMARK OFFICE

CERTIFICATE OF CORRECTION

PATENT NO. : 9,061,809 B2
APPLICATION NO. : 12/496682
DATED : June 23, 2015
INVENTOR(S) : Zoe Claire Wilkins and Paul Bradford It is certified that error appears in the above-identified patent and that said Letters Patent is hereby corrected as shown below:

Title page, add

-- Related U.S. Application Data
(63) Continuation of application No. PCT/US2008/050971, filed on Jan. 14, 2008

(60) Provisional application No. 60/880,269, filed on Jan. 12, 2007, provisional application No. 60/880,202, filed on Jan. 12, 2007, provisional application No. 60/880,221, filed on Jan. 12, 2007 --

Signed and Sealed this
Third Day of November, 2015

Michelle K. Lee

Michelle K. Lee
*Director of the United States Patent and Trademark Office*